US006427374B1

(12) United States Patent
Vaiani

(10) Patent No.: US 6,427,374 B1
(45) Date of Patent: Aug. 6, 2002

(54) APPARATUS FOR SECURING AN OBJECT TO AN INDIVIDUAL

(75) Inventor: JoAnn Vaiani, Wall, NJ (US)

(73) Assignee: Pistol Leash Unlimited, LLC, Spring Lake Heights, NJ (US)

( * ) Notice: Subject to any disclaimer, the term of this patent is extended or adjusted under 35 U.S.C. 154(b) by 0 days.

(21) Appl. No.: 09/428,921

(22) Filed: Oct. 28, 1999

(51) Int. Cl.[7] ..... F41C 23/02
(52) U.S. Cl. ..... 42/85; 119/770
(58) Field of Search ..... 403/164, 327; 24/300, 2.5, 905; 42/85; 150/102, 109; 248/95, 683; 224/150; 190/18 R; 119/787, 792, 863

(56) References Cited

U.S. PATENT DOCUMENTS

| | | | | | |
|---|---|---|---|---|---|
| 156,614 | A | * | 11/1874 | Whitney | 42/85 |
| 1,292,875 | A | * | 1/1919 | Randall | 42/85 |
| 2,783,926 | A | * | 3/1957 | Wise | 224/26 |
| 3,086,268 | A | * | 4/1963 | Chaffin, Jr. | 24/201 |
| 3,211,351 | A | * | 10/1965 | Sample | 224/1 |
| 3,286,751 | A | * | 11/1966 | Dishart | 150/35 |
| 3,579,745 | A | * | 5/1971 | Wilson | 24/73 |
| 3,605,701 | A | * | 9/1971 | Sprenger | 119/106 |
| 3,653,564 | A | * | 4/1972 | Carter | 224/1 |
| 3,825,092 | A | * | 7/1974 | Graydon et al. | 180/82 |
| 3,906,763 | A | * | 9/1975 | Bochory | 70/456 |
| 3,927,808 | A | * | 12/1975 | Steen | 224/1 |
| 3,949,915 | A | * | 4/1976 | Burhans | 224/26 |
| 4,231,137 | A | * | 11/1980 | Fujimoto | 24/201 |
| 4,369,551 | A | * | 1/1983 | Heredia | 24/201 |
| 4,505,012 | A | * | 3/1985 | Johnson | 24/643 |
| 4,939,823 | A | * | 7/1990 | Klein | 24/590 |
| 4,977,860 | A | * | 12/1990 | Harwell | 119/109 |
| 4,998,507 | A | * | 3/1991 | Browning | 119/109 |
| 5,020,348 | A | * | 6/1991 | Scungio | 70/456 |
| 5,067,267 | A | * | 11/1991 | Ives | 42/85 |
| 5,069,168 | A | * | 12/1991 | Robertson et al. | 119/96 |
| 5,134,797 | A | * | 8/1992 | Turner | 42/85 |
| 5,209,090 | A | * | 5/1993 | Stillwagon | 70/456 |
| 5,317,789 | A | * | 6/1994 | Levy | 24/303 |
| 5,318,084 | A | * | 6/1994 | Jackson | 150/109 |
| 5,325,618 | A | * | 7/1994 | Turner | 42/85 |
| 5,664,844 | A | * | 9/1997 | Greene | 297/485 |
| 5,669,170 | A | * | 9/1997 | Norris | 42/85 |
| 5,676,093 | A | * | 10/1997 | Sporn | 119/792 |
| 5,722,125 | A | * | 3/1998 | Vasilopoulos | 24/301 |
| 5,785,221 | A | * | 7/1998 | Bishop | 224/269 |
| 5,842,446 | A | * | 12/1998 | Scott | 119/856 |
| 5,881,487 | A | * | 3/1999 | Chalker | 42/85 |
| 5,934,224 | A | * | 8/1999 | Sporn | 119/792 |
| 5,956,985 | A | * | 9/1999 | Chang | 70/456 |
| 6,000,103 | A | * | 12/1999 | Paice et al. | 24/10 |
| 6,095,093 | A | * | 8/2000 | Kisko et al. | 119/770 |
| 6,112,448 | A | * | 9/2000 | Gray et al. | 42/94 |
| 6,273,029 | B1 | * | 8/2001 | Gish | 119/792 |

* cited by examiner

*Primary Examiner*—Michael J. Carone
*Assistant Examiner*—Denise J Buckley
(74) *Attorney, Agent, or Firm*—Dennison, Schultz & Dougherty

(57) ABSTRACT

A apparatus for securing an object to an individual is disclosed that includes a tether having a first end for attachment to an object and a second end for attachment to a user or to the user's belt or another article of the user's clothing. A guide member, which may be a metal rod connected to and spaced apart from the user's belt, is mounted on the user. The second end of the tether includes a connector such as a loop member that is slidably retained by the guide member.

4 Claims, 1 Drawing Sheet

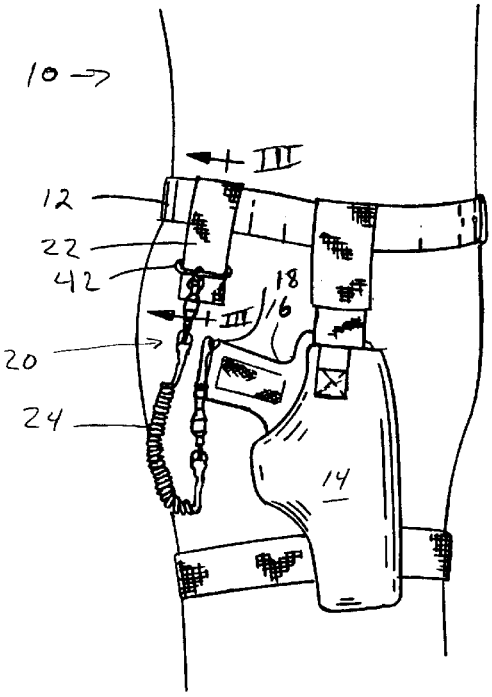
FIG. 1
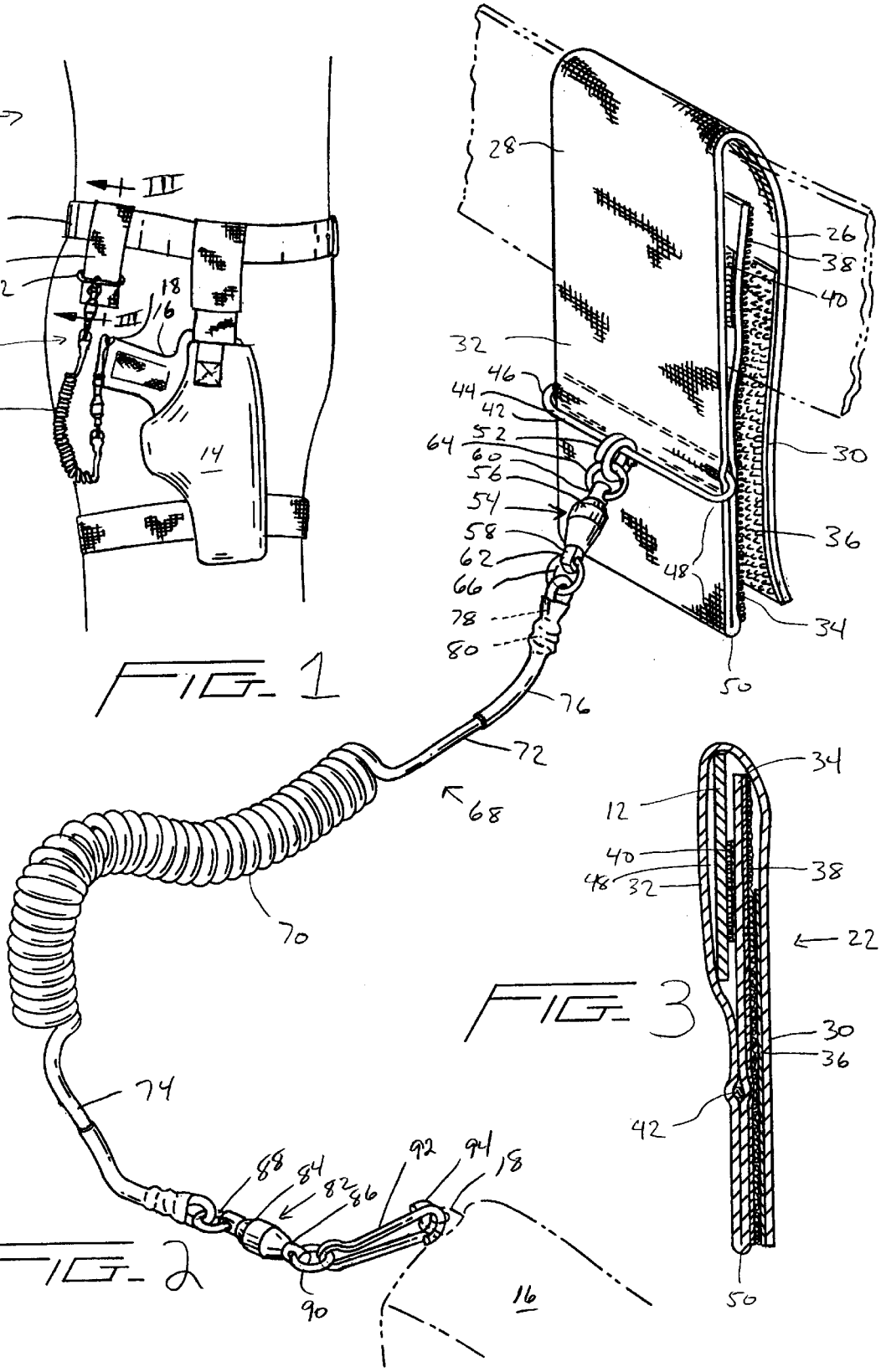
FIG. 2
FIG. 3

APPARATUS FOR SECURING AN OBJECT TO AN INDIVIDUAL

BACKGROUND OF THE INVENTION

Police officers, soldiers, and security personnel are often required to carry handguns or nightsticks or other weapons in the course of their duties. These weapons, when properly used, enable such individuals to perform their jobs effectively and may help save that person's life or the life of another. For maximum effectiveness, weapons must be kept close at hand, and thus they are frequently carried out in the open in a holster on a person's belt or otherwise attached to a person's body.

Care must be taken to prevent malefactors from disarming an authorized user, and to this end, straps, snaps, and other fasteners are often used to hold a weapon securely in a holster. However, on some occasions, such as during a confrontation with a suspected criminal, the weapon will be removed from its holster. At this point it becomes a target for theft by the suspect. If the suspect is strong, or if a person is confronting multiple suspects, a chance exists that the suspect may disarm the authorized user and use the weapon against him. Thus, efforts have been made to secure weapons to the person of authorized users in a manner that leaves the weapon readily available, but prevents the weapon from being removed from the immediate vicinity of the user's person. However, existing products of this type often suffer from problems such as being inconvenient to use and/or interfering with use of the weapon by its owner.

U.S. Pat. No. 5,009,022 to McCoy, for example, shows a cable device that is attachable to the butt of a handgun. The cable is retractably housed in a reel mounted on the user's belt. When the weapon is drawn, the user pulls as much cable as necessary from the reel and uses the weapon. Presumably, the cable is short enough to prevent the weapon from being stolen and used against its owner. However, reel mechanisms are subject to jamming, and a person may suddenly find that he is unable to draw and aim his weapon when confronted with a dangerous situation. When lives are at stake, the use of such a security device is risky.

Other types of lanyard devices can also be used to secure a weapon to an individual, but these devices can interfere with the rapid drawing or reholstering of a weapon. Such devices, disadvantageously, leave the user with a choice between risking the theft of his weapon and the possibility that the weapon will not be immediately available when needed in an emergency.

It would therefore be desirable to provide a device for securing a weapon to a person's body in a manner that leaves it available for free use by the owner of the weapon but that frustrates attempts by unauthorized persons to disarm the user.

SUMMARY OF THE INVENTION

The present invention addresses these problems and others by providing an attachment device that connects a weapon securely to an authorized user, that has no complex mechanisms to jam or malfunction, and that is easy to use and relatively inexpensive to manufacture. While the invention is particularly well-suited for use in retaining weapons, and will be described herein primarily in connection with a handgun, its use is not limited to securing such items and could easily be used to secure a flashlight, tool, cellular phone, or similar object to an individual.

In a preferred embodiment, the invention comprises a strap that wraps around a person's belt and an elongate loop of metal attached to the strap on the side of the strap that faces away from the person's body. The loop serves as a guide or rail for retaining a ring attached to one end of a tether while leaving it free to slide back and forth over the part of the loop that is not in contact with the belt strap. Because of this attachment arrangement, the attached end of the tether has a large degree of freedom and the tether can be oriented in almost any direction. This in turn allows a device attached to the other end of the tether, such as a handgun, to be removed from a holster on a person's belt and returned thereto with a minimum of interference from the tether. Additionally, this arrangement allows the tether itself to be formed from a strong and relatively inflexible material without making the tether awkward to use. Such tethers, if connected directly to a belt, would resist movement in many directions, rendering the weapon more difficult to use. This problem is substantially eliminated by the present invention.

In another aspect, the tether is formed from a flexible but inelastic material such as spring steel. A majority of the length of the tether is coiled into a spring shape that looks and functions much like a coiled telephone cord, and in fact, a length of telephone cord may be used for this purpose. At rest, the coil is compact, but it can easily be stretched to allow the weapon or other item attached to the tether to be used.

Preferably the strap portion of the device that attaches the user's body is formed from a woven material that is strong yet flexible and resistant to cutting and abrasion. The ends of the strap may be joined to one another to hold the strap around a belt using snaps, hook and loop fastening material, or similar connectors. A portion of the elongate loop of metal may be secured to the strap by passing one end of the strap through the loop, folding the end of the strap over and fastening it to itself. Beneficially, when secured in this manner, the elongate loop is free to pivot with respect to the belt to further reduce resistance to tether movement.

It is therefore a primary object of the present invention to provide a tether for attaching an object to an individual.

It is a further object of the present invention to provide a tether for securing a weapon to an individual in a manner that allows use of the weapon only by the individual wearing the tether.

It is another object of the present invention to provide a retractable tether that is compact when not in use but which can quickly and reliably be extended when the tethered object is needed.

It is still a further object of the invention to provide a security device for frustrating attempts at disarming a person carrying a weapon.

It is still another object of the invention to provide a security device for preventing the accidental loss or theft of a weapon.

BRIEF DESCRIPTION OF THE DRAWINGS

These and other objects of the invention will become apparent from a reading and understanding of the following detailed description of a preferred embodiment of the invention taken together with the following drawings of which:

FIG. 1 is a side elevation view showing a holstered weapon connected to an individual's belt with a lanyard according to the subject invention;

FIG. 2 is a perspective view of the lanyard shown in FIG. 1; and,

FIG. 3 is a sectional side elevational view of the strap portion of the subject lanyard taken through line III—III in FIG. 1.

DETAILED DESCRIPTION OF A PREFERRED EMBODIMENT

Referring now to the drawings, wherein the showings are for purposes of illustrating a preferred embodiment of the subject invention only, and not for purposes of limiting same, FIG. 1 shows a person 10 wearing a belt 12, a holster 14 attached to belt 12, and a weapon 16 carried in the holster which weapon includes a ring or opening 18 for receiving a hook or connector to connect the weapon to its owner or authorized user. A lanyard device, designated generally by the numeral 20, connects weapon 16 to belt 12.

Lanyard 20 comprises a strap portion 22 and a tether 24. Strap 22 is preferably formed from a woven nylon material that is stiff and strong but flexible enough to be folded over onto itself one or more times. Leather, flexible plastics, and other materials could also be used to form this strap. Strap 22 is preferably about 14 inches long and two inches wide, has a first face 26 and a second face 28, and is divided longitudinally into three sections, an outer end section 30, a middle section 32, and an inner end section 34.

Hook and loop fastening material is used to fasten strap 22 to itself and around a user's belt. A first portion of hook-type fastening material 36 is connected to outer end section 30 on first face 26 and a second portion of loop-type fastening material 38 is connected to inner end section 34 on the second face 28 thereof. Both sections of hook-and-loop fastening material are attached to strap 22 using stitching and/or a suitable adhesive. A second, smaller section of hook type fastening material 40 is also connected to strap inner end section 34 on a first face thereof near the terminal end of the strap.

An oblong metal loop 42 having first and second linear portions 44 connected by first and second bight portions 46 is attached to strap 22 by sliding it over one end of the strap until it overlies a portion of middle strap section 32. Inner end section 34 is then folded over middle section 32 to bring the first face of inner end section 34 into contact with the first face of middle section 32 and sandwich metal loop 42 therebetween. The inner and middle sections of the strap are fastened together with stitching 48 shown in FIG. 2, that runs parallel to the loop 42 and is spaced a small distance from either side thereof. The stitching is close enough to the linear portion of the metal loop to hold the metal loop securely in place and prevent substantially all movement of the loop with respect to the strap. Secured in this manner, however, rotation of the loop about the linear portion 44 enclosed between the two strap sections is allowed. Preferably, an adhesive (not shown) is used to permanently secure inner end section 34 to middle section 32 in the area 48 between stitching 48 and a fold 50 between the middle and inner sections. The remaining portion of inner end section 34, including second segment 40 of hook-type fastening material, is not connected to middle section 32 and can be partially folded away therefrom.

To attach strap 22 to belt 12, the belt is passed through area 48 between the middle section 32 and the inner end 34. Second section 40 of hook type fastening material contacts belt 12 in this configuration, and the rough surface provided by the fastening material increases the friction between the belt and helps reduce movement of the strap relative to the belt. Outer end section 30 is inserted between belt 12 and body of user 10 and folded to that the first section 36 of hook type fastener contacts loop type fastener 38. The strap is thus securely fastened to a user's belt in a way that makes it difficult to remove without loosening the user's belt but that is very easy to remove once the belt is loosened. This leads to ease of attachment and removal for the wearer, but makes the strap almost impossible to remove during a confrontation.

Tether 24, which attaches between strap 22 and weapon 16, will now be described in detail. The tether comprises a first metal ring 52 connected to the linear portion 44 of loop 42 so that it is free to slide between the first and second bights 46. Linear portion 44 thus serves as a rigid rail for slidingly supporting ring 42, and strap or holder 22 serves as a rail support for holding the rail in a proper orientation. Preferably, the diameter of ring 52 is at least several times greater than the cross sectional diameter of linear portion 44 of the loop to allow the ring substantial freedom to twist, slide, and rotate with respect to metal loop 42. Ring 52 may be formed in any manner, but in the preferred embodiment, comprises two coils of an expansion spring material which coils are normally held tightly together but which can be separated by applying force so that an object, such as the linear portion of loop 42, can be inserted therebetween and into the center of the ring. In this way the ring is similar to a typical metal key ring.

To ring 52 is attached a swivel device 54 comprising a swivel body 56 and a swivel element 58 retained in swivel body 56 such that body 56 and element 58 can swivel with respect to one another along a central axis of the device 54. Swivel body 56 further includes a bore 60 while swivel element 58 includes a bore 62, which bores facilitate the connection of the swivel device to other objects. A swivel body ring 64 is received in bore 56 and is connected to ring 52 to secure the swivel device to metal loop 42. A swivel element ring 66 is received in bore 52 for a purpose described hereinafter.

Tether 24 further comprises a cord 68. Cord 68 may be formed from a variety of materials, but in the preferred embodiment is a rubber-coated length of steel wire or cable, such as a 5-cable telephone cord, that includes a central portion 70 coiled into the form of an expansion spring. The first and second end portions 72, 74 of cord 68 are not coiled. This configuration allows cord 68 to act like a spring—when the end portions 72 and 74 are pulled apart, central portion 70 stretches until the coils are substantially flattened. When the end portions are released, the cord contracts and returns to its original form.

First end 72 of cord 68 is attached to swivel element ring 66 in the following manner. First, a sleeve 76, formed from a heat-shrinkable rubber tubing is placed over end 72 of cord 68 and pushed toward central portion 70 such that the terminal end of the cord is free. Next, end 72 is passed through swivel element ring 66, and an end portion 78 of the cord is folded over onto the cord. A short length of wire 80 is twisted about folded over end portion 78 to secure it to end 72. Sleeve 76 is then pulled over the wire 80 and folded over portion 78 until it reaches swivel element ring 66. Heat is then applied to shrink the sleeve to form a tight fit between the sleeve and the cord.

A second swivel device 82 identical to swivel device 54 is connected to end 74 of cord 68 using wire and a sleeve in the same manner described above in connection with the first swivel device. Swivel device 82 comprises a swivel body 84, a swivel element 86, a swivel body ring 88 and a swivel element ring 90 all of which are connected and function in the same manner discussed above in connection with swivel device 54.

A spring clip 92 is connected to swivel element ring 90 and includes end portions 94 normally biased into contact with each other but that can be separated to allow clip 92 to be connected to lanyard ring 18 on weapon 16. By making such interconnections, weapon 16 is now tethered to a user's body.

The lanyard described above securely connects a weapon to a user, yet, unlike certain prior art devices, only minimally interferes with the drawing and reholstering of the weapon. First, as seen in FIG. 1, holster 14 is mounted on a user's belt in a conventional location. Strap 22 is mounted on belt 12 at a location rearward of the butt of weapon 16. Lanyard 20 hangs loosely between weapon 16 and strap 22, and due to the flexibility of cord 68 and large amount of relative movement allowed by the interconnections of the rings and the connection between ring 52 and loop 42, does not push or pull on weapon 16 or change the feel of the weapon in the holster in an appreciable manner. Furthermore, because lanyard 20 hangs rearwardly of the butt of the weapon, it does not interfere with a user's draw.

To unholster the weapon, a user unfastens any holster retaining strap and pulls the weapon from the holster in a normal fashion. This involves first pulling the weapon upwardly and slightly toward the user's rear. This motion may slide ring 52 rearwardly on loop 42 away from the holster. As the weapon is brought to a firing position at the user's hip or in front of the user, ring 52 slides freely along loop 42 in the direction of holster 14.

Significantly, the connections between the rings, swivels, cord and loop allow the weapon to follow practically any path and to assume almost any orientation as it is drawn. The user can twist his wrist in either direction during the drawing operation and the swivel devices will allow the weapon to move with negligible resistance. The barrel of the weapon can be moved in a vertical or horizontal arc, and the ring connections will slide, pivot and twist accordingly. The user can move the weapon in forward and rearward directions with respect to his body and notice little or no resistance as ring 52 slides along loop 42 during the process. The ring, loop and swivel arrangement make kinks or snags almost impossible. Until the weapon's movement begins to stretch coiled portion 70, the connections adjust to substantially all movements of the weapon making the lanyard almost unnoticeable. The same holds true during reholstering.

While the overall arrangement of the lanyard and ring connections is significant to providing the improved tether of the subject invention, an important feature of the invention lies in the connection between ring 52 and loop 42. In prior devices, this connection between a tether and the user was likely to be the source of many problems. For example, if the end of cord 68 was merely stitched between two section of strap 22, this inflexible connection would resist movement during the drawing and reholstering of the weapon. Other connection methods pose similar problems. Even if the resistance could be overcome by the user, such resistance is often distracting, and may cause the user to divert his attention while drawing his weapon. Likewise, a user may be concentrating on handcuffing a suspect or another important action as he returns his weapon to his holster. If a lanyard kinks or otherwise resists movement at this critical time, the user may be distracted, potentially to his detriment. The lanyard of the present invention thus provides improved performance, and is less noticeable to the user, than typical prior art devices.

The subject invention has been described in terms of a preferred embodiment thereof. It should be appreciated however, that various modifications and additions will become apparent to those skilled in the relevant arts after a reading and understanding of the foregoing description. For example, different arrangements could be used for connecting loop 42 to a user—the loop could be mounted to a different type of strap or directly to the user's belt, for example. And while the holster described above is worn on the user's belt, the subject lanyard could easily be adapted for use in connection with a shoulder holster. It is intended that all such obvious modifications and additions be covered by this application to the extent that they are included within the scope of the several claims appended hereto.

I claim:

1. An apparatus for securing a handgun to an individual to enable both secure holster storage and secure positioning of the handgun for use comprising in combination:

a stretchable and retractable tether having a first end and a second end;

a first connector secured to the first end of the tether for releasably attaching the handgun to said tether;

an elongated strap for attachment to the individual;

a rigid rail secured to said strap and comprising first and second elongated and parallel linear portions and bite portions at either end connected to said linear portions;

a second connector secured to the second end of the tether including a rail ring adopted to encircle and slide upon one of said linear portions of said rail;

a swivel having first and second mutually swivelable parts;

first and second swivel rings attached to said first and second parts, said first swivel ring being connected to said rail ring and said second swivel ring being connected to the second end of said tether; and wherein, said rigid rail is pivotably connected to said strap for pivotable movement about the longitudinal axis of said linear portion relative to the individual.

2. The apparatus of claim 1, wherein said rigid rail comprises an elongate metal loop.

3. The apparatus of claim 1, wherein said tether is formed from a coiled elastic cord.

4. In an apparatus for attaching an object to an individual, said device including a holder securable to the individual, a stretchable and retractable tether having a first end, said end having a first connector connected to said holder and a second end having a second connector connectable to said object, the improvement comprising in combination;

said holder including a rigid rail and said first connector comprising a rigid ring surrounding and supported by said rigid rail for free sliding movement there along, said rigid rail comprising first and second spaced apart parallel linear portions and bite portions on opposite ends joining said linear portions to form an elongated loop, one of said linear portions being secured to said holder and being free to rotate about its longitudinal axis, said other linear portion receiving the rigid ring, whereby said rigid ring moves with respect to said rigid rail when said tether is moved.

* * * * *